US005414980A

United States Patent [19]

Shibazaki et al.

[11] Patent Number: 5,414,980

[45] Date of Patent: May 16, 1995

[54] PACKING APPARATUS

[75] Inventors: Tokio Shibazaki, Osaka; Seiichiro Koyama, Tokyo, both of Japan

[73] Assignee: Strapack Corporation, Tokyo, Japan

[21] Appl. No.: 147,965

[22] Filed: Nov. 5, 1993

[30] Foreign Application Priority Data

Nov. 5, 1992 [JP] Japan ..... 4-295559

[51] Int. Cl.[6] ..... B65B 13/06; B65B 51/10

[52] U.S. Cl. ..... 53/589; 53/375.9; 100/26

[58] Field of Search ..... 100/25, 26; 53/589, 53/375.9

[56] References Cited

U.S. PATENT DOCUMENTS

| | | | |
|---|---|---|---|
| 3,179,037 | 4/1965 | Cranston et al. | 100/26 |
| 3,768,396 | 10/1973 | Coleman | 100/26 |
| 4,278,014 | 7/1981 | Knieps | 100/26 |
| 4,520,720 | 6/1985 | Urban et al. | 100/26 |
| 4,781,110 | 11/1988 | Sakaki et al. | 53/589 X |
| 4,867,053 | 9/1989 | Kawai et al. | 53/589 X |

*Primary Examiner*—Linda B. Johnson
*Attorney, Agent, or Firm*—Steinberg, Raskin & Davidson

[57] ABSTRACT

A packing apparatus capable of permitting drawing-out of a band from a band guide arch structure to be regularly accomplished in order, to thereby improve durability of the apparatus and prevent damage to the band. Flaps each are formed of a lightweight metal material into an L-shape in section, and are provided at one edge thereof with a flange and formed at a portion thereof in proximity to the other edge thereof with a pair of threaded holes. The flaps are arranged in a manner to be contiguous to each other in order in such a manner that a forward end of each of the flaps defined in a direction of delivery of the band is positioned under a rearward end of the flap forwardly adjacent thereto while aligning threaded holes of the adjacent flaps with each other. Also, the flaps which are arranged at each of corner sections of a band way are curvedly connected to each other while forming an overlapped portion of an acute fan shape between each adjacent two flaps. Springs of a coiled shape each are securely inserted at one end thereof into each of the threaded holes of each of the overlapped portions of the flaps and fixed at the other end thereof in a band guide arch structure, to thereby permit each of the flaps to be openable with respect to the band way.

13 Claims, 8 Drawing Sheets

PACKING APPARATUS

BACKGROUND OF THE INVENTION

This invention relates to a packing apparatus for traveling a band along a band way while keeping a packed object or package stationary on a fixed member such as a table or the like and drawing out the band from the band way to tightly wind it around the package, and more particularly to a flap construction of a band guide arch structure in such a packing apparatus.

A conventional packing apparatus is generally constructed in such a manner as shown in FIGS. 1 to 7. More particularly, the conventional packing apparatus, as shown in FIG. 1, includes a body 1, on which a pair of tables 2 and 3 are fixedly mounted. The tables 2 and 3 are arranged so as to be horizontally spaced from each other at a predetermined interval, resulting in being a band passage 4 being defined therebetween. On the tables 2 and 3 is arranged a band guide arch structure 5 of a substantially inverted U-shape in a manner to extend between both ends of the tables 2 and 3 and straddle the band passage 4.

The band guide arch structure 5, as shown in FIG. 2, a central arch frame 6 and arch covers 7*a* and 7*b* arranged so as to interpose the arch frame 6 therebetween. The arch frame 6 is provided on an inner side or inner periphery thereof with a band way 8, so that a band B may travel on a surface of the band way.

The arch frame 6, as shown in FIG. 3, is mounted thereon through a plurality of support members 10 with flaps 11 and 12. The flaps 11 and 12, as shown in FIG. 2, each are formed into an L-shape in cross section and fixedly mounted at one end thereof with a member including at least a pair of support elements 13 in a manner to be integral therewith. The support elements 13 each are formed with a through-hole 14.

The flaps 11 each are formed into a straight or linear shape and arranged on each of straight or linear sections of the arch frame 6 and the flaps 12 each are formed into a curved shape and arranged on each of corner sections of the arch frame 6.

The support members 10 each are formed into a substantially flat U-shape, resulting in being proved at both ends thereof with lugs 15 and mounted a bottom portion thereof on the arch frame 6. The lugs 15 each are formed with a through-hole 16 and a small through-hole 17. Each of the support members 10 is fixed on a side surface of the arch frame 6. The flaps 11 and 12 each are mounted on the support member 10 by fitting the support elements 13 in the support member 10 while aligning the through-holes 14 of the support elements 13 with the through-holes 16 of the lugs 15. Then, a support shaft 19 having a spring 18 wound thereon is inserted through the aligned holes 14 and 16, to thereby mount each of the flaps 11 and 12 through each of the support members 10 on the arch frame 6. The spring 18, as shown in FIG. 3, is provided at a central portion thereof with a U-shaped presser portion 20, through which the spring 18 is divided into two sections, which are wound in directions opposite to each other. Also, a shaft 21 is heldly inserted through the small through-holes 17 of each of the support members 10 to hold both ends of the spring 18, as shown in FIG. 3.

The spring 18 acts to restrain each of the flaps 11 and 12 through the presser portion 20 of the spring 18. Also, the flaps 11 and 12 each are arranged so as to be pivotally moved in a direction indicated at an arrow in FIG. 3 from a position shown in FIG. 3, however, it is not pivotally moved in a direction opposite to the direction of the arrow because each of the support element 13 is abutted at a proximal portion thereof against the support member 10. This permits each of the flaps 11 and 12 and the band way 8 to be normally spaced in parallel from each other at a predetermined interval, to thereby define a space therebetween, as shown in FIG. 3, so that the band B may travel in the space thus defined.

When force is applied to each of the flaps from the side of the band way 8, elastic force of the spring 18 causes the flap to be pivotally moved in a direction of application of the above-described force from the band way 8, so that the flap is rendered open to expose the band way 8. Thus, it will be noted that each of the flaps 11 and 12 is openable about the support shaft 19 with respect to the band way 8.

Reference numeral 6*a* in FIG. 3 designates a band guide plate. The band guide plate 6*a* is arranged on a side of the arch frame 6 opposite to a side thereof on which the support member 10 is provided and acts to prevent the band B traveling along the band way 8 from being dislocated from the band way 8.

Now, an internal structure of the body 1 will be described hereinafter.

The body 1, as shown in FIG. 1, is mounted thereon with an upper presser plate 9 in a manner to be reciprocated in a direction perpendicular to a band travel path of which at least a part is defined by the band passage 4. For this purpose, the upper presser plate 9 is constructed so as to retractably project in the direction traversing or perpendicular to the band travel path. Also, the body 1, as shown in FIG. 4, is provided therein with a band guide 22 for guiding the band B to the band way 8. The band guide 22 is constructed so as to retractably project toward the band travel path as in the upper presser plate 9. The band guide 22 is formed into a substantially U-shape in section and provided therein with a guide groove 23, through which the band B is guided to the band way 8 while being received in the guide groove 23. Further, the band guide 22 is provided on an upper surface thereof with a stopper 24, which comprises a projection formed by upwardly projecting the upper surface of the band guide 22 and provided so as to be contacted with a lower surface of the upper presser plate 9. The stopper 24 is arranged so as to ensure a sufficient distance between the stopper 24 and a band inlet 23*a* of the guide groove 23 in a horizontal direction. More particularly, the stopper 24 is positioned in proximity to a band outlet 23*b* of the guide groove 23 rather than the band inlet 23*a*.

In addition, the body 1, as shown in FIG. 6, includes a right-hand presser member 25, a left-hand presser member 26, a heater 27, a press member 28, and a lower blade 29 integrally mounted on the press member 28. These members cooperate with each other to construct a sealing mechanism.

The right-hand presser member 25 is positioned on an upstream side in a direction of travel of the band B based on the band inlet 23*a* of the band guide 22 as shown in FIG. 4 and arranged in a manner to be vertically movable. The right-hand presser member 25 is formed with a guide hole 30. The guide hole 30 has an outlet defined on a downstream side in the direction of travel of the band B. The outlet serves as an upper blade 31, which cooperates with the above-described lower blade 29 to constitute a cutter mechanism. Also, the right-hand presser member 25 is provided on an upper end thereof with a non-slip portion 25*a*, which is arranged so as to be pressedly contacted with the lower surface of the upper presser plate 9 when the right-hand presser member 25 is raised to an uppermost position. The non-slip portion 25*a* and upper presser plate 9 cooperate with each other to provide a holding mechanism for interposedly holding a distal portion of the band B therebetween.

The left-hand presser member 26 is arranged below the upper presser plate 9 and at a position opposite to the band outlet 23*b* of the guide groove 23 of the band guide 22 in a manner to be slidable in a vertical direction. Also, the left-hand presser member 26 is provided at an upper end thereof with a non-slip portion 26*a*. The left-hand presser member 26 thus constructed is raised after the band guide 22 is retracted from the band travel path, so that the non-slip portion 26*a* of the presser member 26 may be pressedly contacted with the lower surface of the upper presser plate 9, resulting in the band B being interposedly held between the non-slip portion 26*a* of the presser member 26 and the lower surface of the upper presser plate 9.

The heater 27 is arranged in a manner to be retractably positioned with respect to the band travel path, to thereby be selectively positioned in or out of the band travel path.

The press member 28 is likewise arranged below the upper presser plate 9 and at a position opposite to the band inlet 23*a* of the guide groove 23 of the band guide 22 in a manner to be movable in the vertical direction. The press member 28 is integrally mounted thereon with the lower blade 9 and raised after the band guide 22 is retracted from the band travel path.

Further, the body 2, as shown in FIG. 4, is provided therein with a feed roller 32 and an upper roller 33, which are arranged outside the right-hand presser member 25. The feed roller 32 and upper roller 33 cooperate with each other to constitute a band delivery mechanism. On the outside of the rollers 32 and 33 is arranged a tension arm 34 as shown in FIG. 6, which is provided with a passage 35 through which the band B is passed, a tension jaw 37 pivotally moved about a pin 36, and a presser member 38 for forcibly pivotally moving the tension jaw 37 in a clockwise direction in FIG. 6.

The tension arm 34, tension jaw 37 and presser member 38 cooperate with each other to provide a tension mechanism.

Now, the manner of operation of the conventional packing apparatus constructed as described above will be described hereinafter with reference to FIGS. 4 to 7 as well as FIG. 1.

First, a package W is put on the tables 2 and 3 so as to be positioned below the band guide arch structure 5 as shown in FIG. 4. Then, the band guide 22 is kept at a raised position and the guide hole 30 of the right-hand presser member 25 is positioned so as to be opposite to or aligned with the guide groove 23 of the band guide 22. Subsequently, the band wound on a reel 39 is drawn out through a pool box from the reel 39 and then inserted into the guide hole 30 of the right-hand presser member 25 and the guide groove 23 of the band guide 22 through the tension mechanism and band delivery mechanism.

Then, the feed roller 32 constituting a part of the band delivery mechanism is rotated in a direction indicated at an arrow in FIG. 4, so that the band B is permitted to travel at a high speed along the band way 8 in the band guide arch mechanism 5, resulting in a distal end of the band B coming into collision with the stopper 24 of the band guide 22.

Subsequently, the right-hand presser member 25 is further raised as shown in FIG. 5, so that the band B is interposedly held between the non-slip portion 25*a* of the right-hand presser member 25 and the upper presser plate 9. Then, the band guide 22 is retracted from the band travel path.

Thereafter, the feed roller 32 is reversely rotated in a direction indicated at an arrow in FIG. 5, to thereby pull the band B in a direction indicated at an arrow in FIG. 5, resulting n tension being applied to the band B. This causes pull-back force to be applied to the band B, so that the band B arranged in a loop-like manner in the gap between the band way 8 and each of the flaps 11 and 12 forcedly opens the flap, to thereby be drawn out of the gap between the band way 8 and the flap. This results in the band B being tightly wound on the package W as shown in FIG. 5.

Then, the tension Jaw 37 is pivotally moved in the clockwise direction while being forced by the presser member 38 of the tension mechanism, so that the band B may be firmly held. Then, the tension arm 34 is rotated in a direction indicated at an arrow in FIG. 6, to thereby further pull the band B. After the band B is thus pulled, the left-hand presser member 26 is raised to an uppermost position to interposedly hold the band B between the non-slip portion 26*a* of the left-hand presser member 26 and the upper presser plate 9. In this state, the band B is so arranged that the above-described distal portion of the band B defined on the basis of a direction of delivery of the band is kept vertically spaced from a proximal portion of the band positioned between the right-hand presser member 25 and the left-hand presser member 26, resulting in a gap being defined between the distal portion and the proximal portion as shown in FIG. 6. Then, the heater 27 is inserted into the gap thus formed. In addition, the press member 28 is upwardly moved, resulting in the lower blade 29 mounted on the press member 28 being likewise raised, so that the lower blade 29 cooperates with the upper blade 31 formed by the inlet of the guide hole 30 to cut the band B. Concurrently, the heater 27 melts the distal and proximal portions of the band B between which the heater is inserted. Then, the press member 28 is downwardly moved and the heater 27 is retracted.

Subsequently, the press member 28 raised again as shown in FIG. 7, so that the melted distal and proximal portions of the band B are adhered to each other. Finally, the left-hand presser member 26 and press member 28 are lowered and the upper presser plate 9 is retracted, so that the band B is firmly wound on the package W while being tightly contacted therewith.

Unfortunately, it was found that the conventional packing apparatus constructed as described above exhibits some disadvantages.

More particularly, the draw-back force applied to the band B as described above causes the band B to forcedly open each of the flaps 11 and 12, resulting in the band B being drawn out from the gap between each of the flaps 11 and 12 and the band way 8. At this time, a failure in adjustment of force by which each of the curved flaps 12 arranged at the corner sections is pivotally moved causes the band B to be drawn out from the flap 12 at each of the corner sections of the arch frame 6 of the band arch guide structure 5 concurrently or irregularly. For example, when elastic force of the spring 18 of each of the curved flaps 12 at the corner sections is smaller than the draw-back force of the band B, the band B is caused to be drawn out from any one of the curved flaps 12 at the corner sections before it is drawn out in order from an inlet end side of the band guide arch structure 5 toward an outlet end side thereof. Alternatively, when elastic force of the spring 18 is excessively large, drawing-out of the band B from the curved flap 12 at each of the corner sections is rendered highly difficult. Thus, drawing-out of the band B from each of the flaps 12 at the corner sections is lastly carried out, so that drawing-out of the band B from the flaps 11 and 12 is rendered irregular.

Unfortunately, such irregular drawing-out of the band B from the flaps causes a failure in uniform winding of the band B around the package W, leading to troubles such as slack of the band B, twist thereof and the like.

Also, the drawing-out of the band B from the flaps is carried out in order of O→P→Q→R in the clockwise direction as shown in FIG. 1, resulting in adjustment of the springs 18 being required in correspondence to operation of the flaps at the straight sections and corner sections and depending on order of drawing-back of the band from the flaps at the corner sections.

It is required to increase a degree at which the flaps 12 at the corner sections O, P, Q and R are open by an amount corresponding to bending of the flaps 12 as compared with the flaps 11 at the straight sections. Otherwise, drawing-out of the band from the flaps 12 at the corner sections is failed. This requires an increase in angle at which the flaps at the corner sections O, P, Q and R are pivotally moved. Unfortunately, an increase in angle of pivotal movement of the flaps 12 causes the flaps to be contacted with the arch frame 6 of the band guide arch structure 5 when the flaps 12 are returned to the original position, resulting in noise or contact sound being produced.

Thus, the conventional packing apparatus causes a considerable amount of load to be applied to each of the springs 18 at the corner sections of the arch frame 6, therefore, fine adjustment of the spring 18 described above which is highly troublesome must be carried out while paying attention to durability of the spring.

SUMMARY OF THE INVENTION

The present invention has been made in view of the foregoing disadvantage of the prior art.

Accordingly, it is an object of the present invention to provide a packing apparatus which is capable of permitting drawing-out of a band from a band guide arch structure to be regularly accomplished in order.

It is another object of the present invention to provide a packing apparatus which is capable of carrying out drawing-out of the band while keeping a posture of the drawing-out in parallel to a band way.

It is a further object of the present invention to provide a packing apparatus which is capable of substantially decreasing contact sound produced when flaps each are returned to its original position at which it covers a band way.

In accordance with the present invention, a packing apparatus is provided which includes a package positioning means on which a package is put and kept stationary, a band passage provided on the package positioning means, a band guide arch structure arranged on the package positioning means and including an arch frame, a band way provided in the band guide arch structure so as to include corner sections and linear sections; a plurality of flaps openably mounted on a side of the arch frame through springs so as to to cover the band way in a substantially whole width direction thereof while defining, over a whole length of the band way, a gap through which the band is passed, an upper presser plate arranged so as to be retracted with respect to the band passage, a band delivery mechanism for delivering the band and removing slack of the band after the band is wound around the package, a holding mechanism for interposedly holding a distal end of the band between a lower surface thereof and the upper presser plate, a tension mechanism for applying tension to the band held by the holding mechanism, a heater arranged so as to be retracted with respect to a position below the upper presser plate, resulting in being selectively inserted between portions of the band lying one upon another below the upper presser plate to melt the portions of the band lying one upon another, a press member for adhering the portions of the band melted by the heater to each other while pressing the melted portions, and a cutter mechanism for cutting a part of the band wound on the package from the remaining part of the band.

The packing apparatus of the present invention generally constructed as described above is featured in that the flaps each are made of a lightweight metal material and formed into an L-shape in section, the flaps are provided at one edge thereof with a flange and formed at a portion thereof in proximity to the other edge thereof with a pair of threaded holes, the flaps are arranged in a manner to be contiguous to each other in order in such a manner that a forward end of each of the flaps defined in a direction of delivery of the band is positioned under a rearward end of the flap forwardly adjacent thereto while aligning the threaded holes of the adjacent flaps with each other, the flaps arranged at each of the corner sections of the band way are curvedly connected to each other while forming an overlapped portion of an acute fan shape between each adjacent two flaps, and springs of a coiled shape each are securely inserted at one end thereof into each of the threaded holes of each of the overlapped portions of the flaps and fixed at the other end thereof in the band guide arch structure, to thereby permit each of the flaps to be openable with respect to the band way.

BRIEF DESCRIPTION OF THE DRAWINGS

These and other objects and may of the attendant advantages of the present invention will be readily appreciated as the same becomes better understood by reference to the following detailed description when considered in connection with the accompanying drawings in which like reference characters designate like or corresponding parts throughout; wherein.

DETAILED DESCRIPTION OF THE PREFERRED EMBODIMENT

Now, a packing apparatus according to the present invention will be described hereinafter with reference to FIGS. 8 to 12 as well as FIGS. 1 to 7 described above in connection with the prior art.

Figure 1:
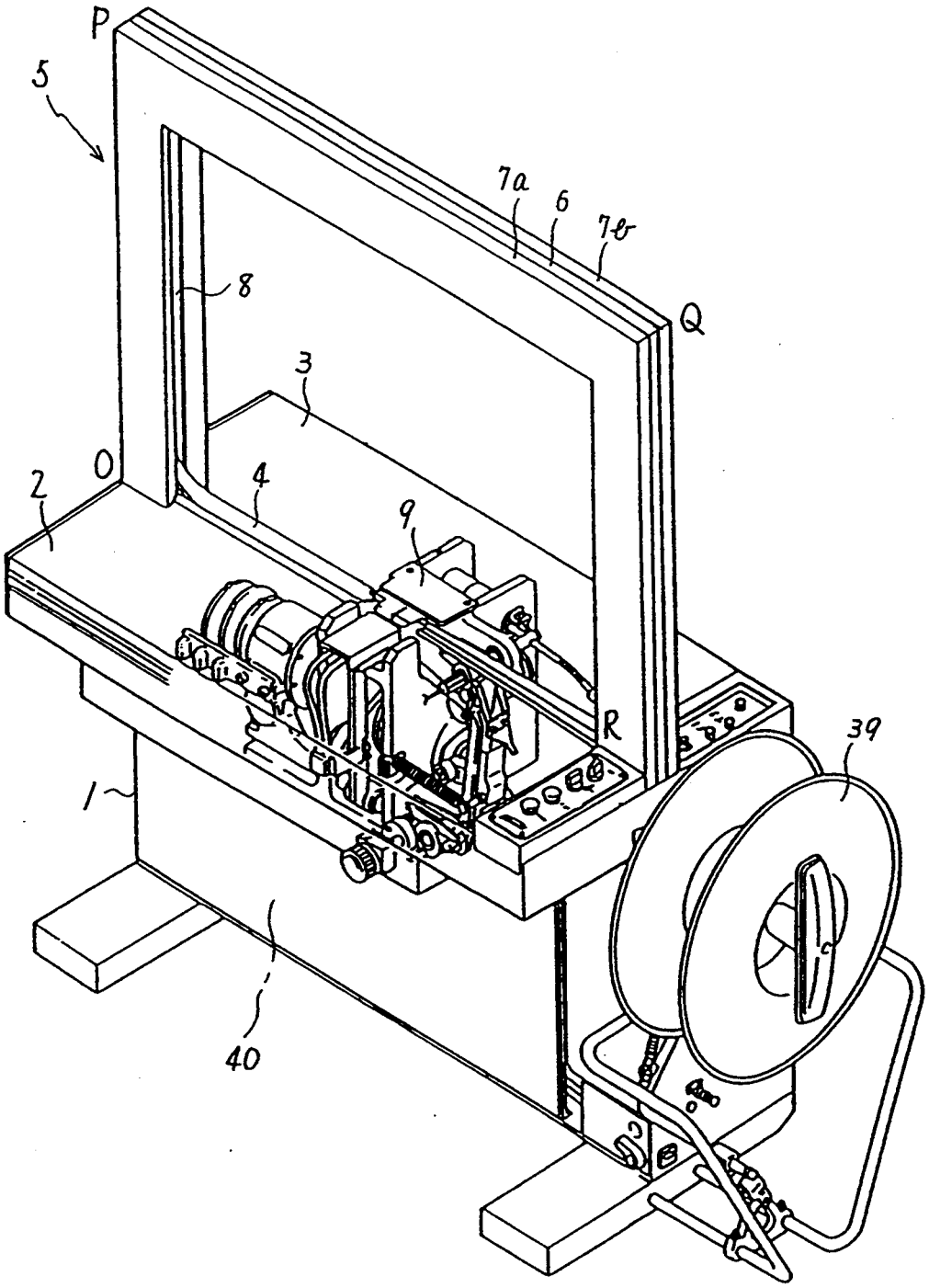
FIG. 1 PRIOR ART
FIG. 1 is a perspective view generally showing a conventional packing apparatus.
Figure 2:
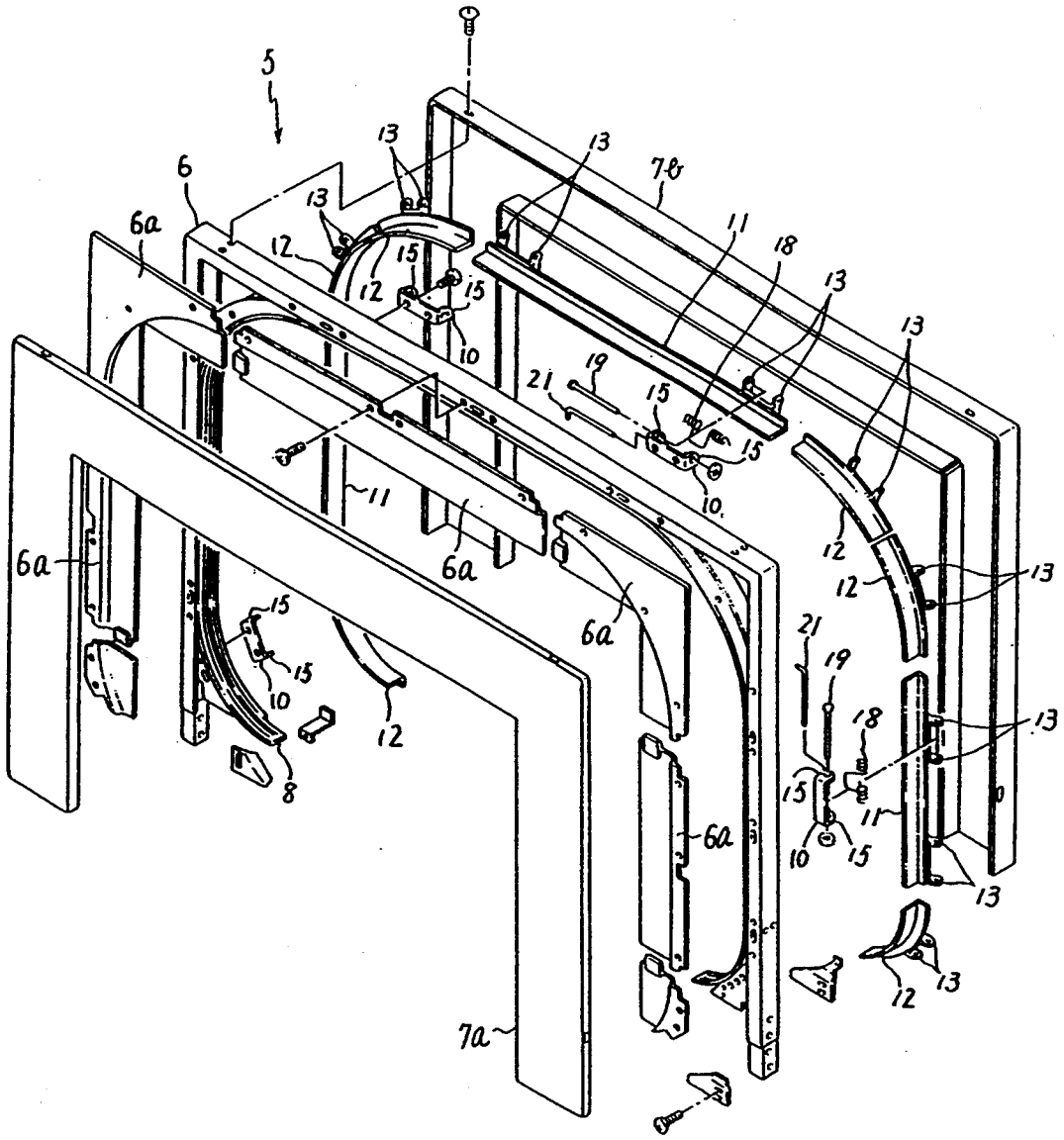
FIG. 2 PRIOR ART
FIG. 2 is an exploded perspective view showing a band arch guide structure in the conventional packing apparatus shown in FIG. 1.
Figure 3:
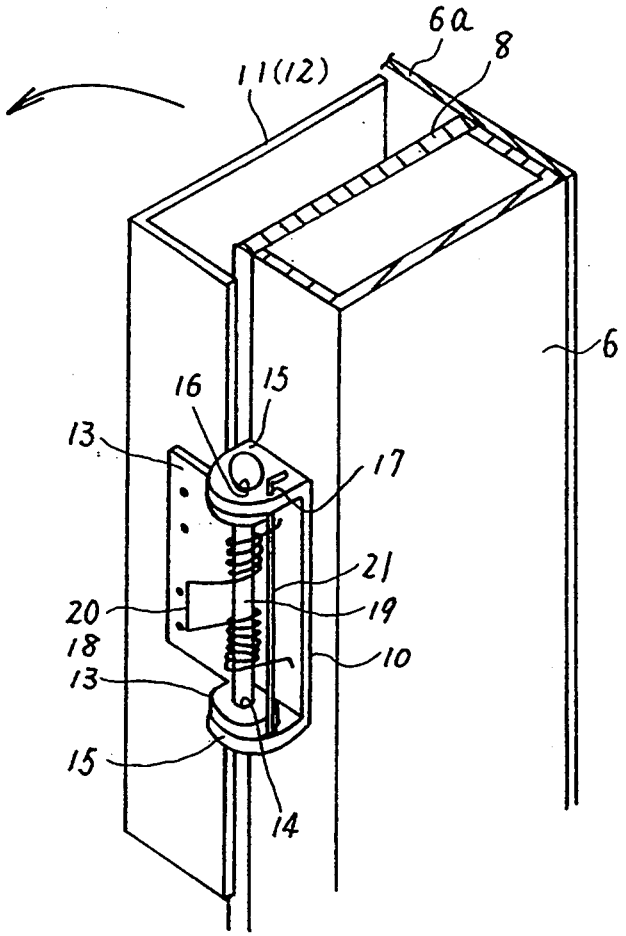
FIG. 3 PRIOR ART
FIG. 3 is an enlarged perspective view showing a flap mounted on a band guide arch structure in the conventional packing apparatus shown in FIG. 1.
Figure 4:
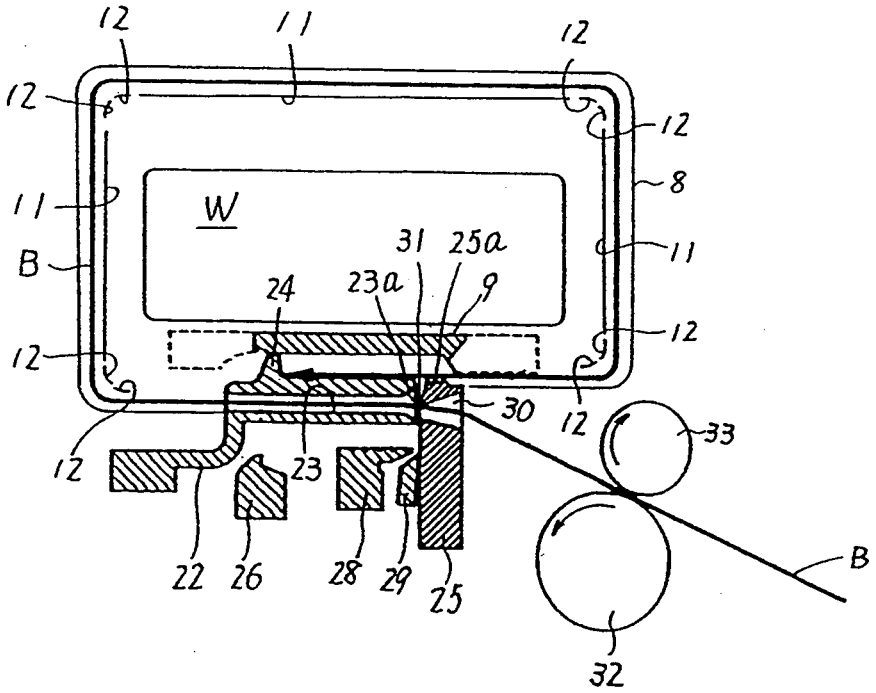
FIG. 4 PRIOR ART
FIGS. 4 to 7 each are a vertical sectional schematic view showing operation of an internal structure incorporated in the packing apparatus shown in FIG. 1.
Figure 5:
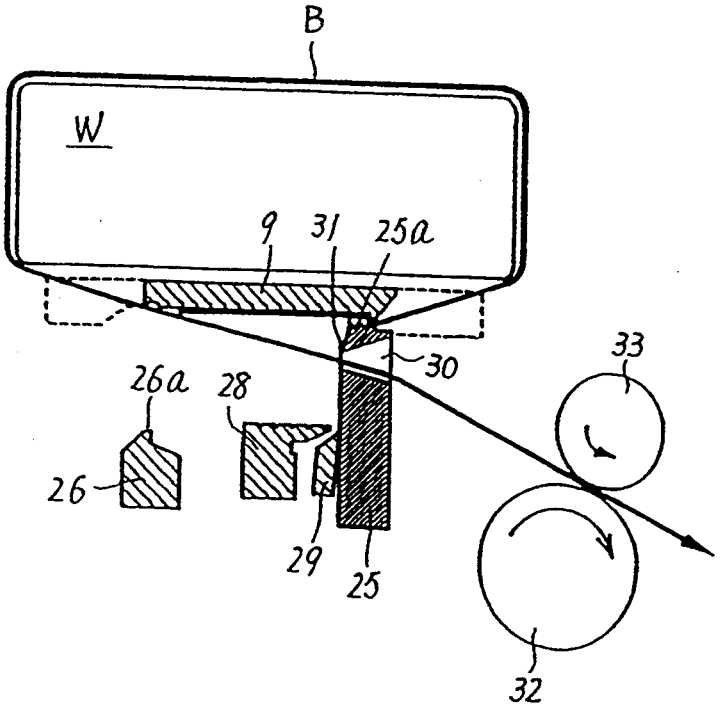
FIG. 5 PRIOR ART
Figure 6:
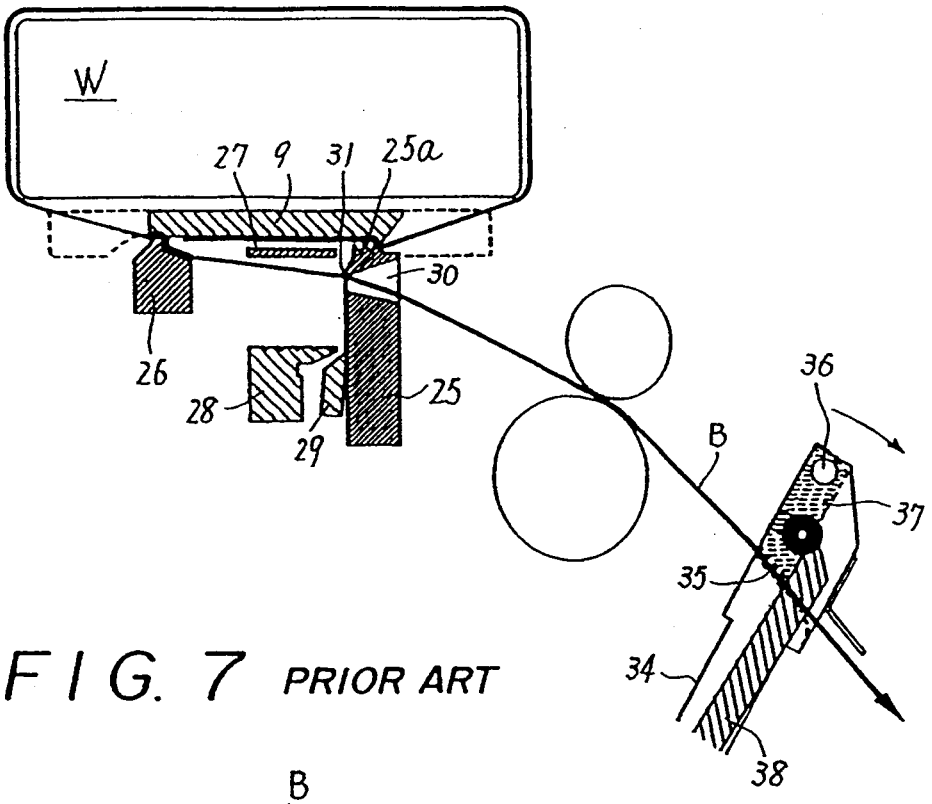
FIG. 6 PRIOR ART
Figure 7:
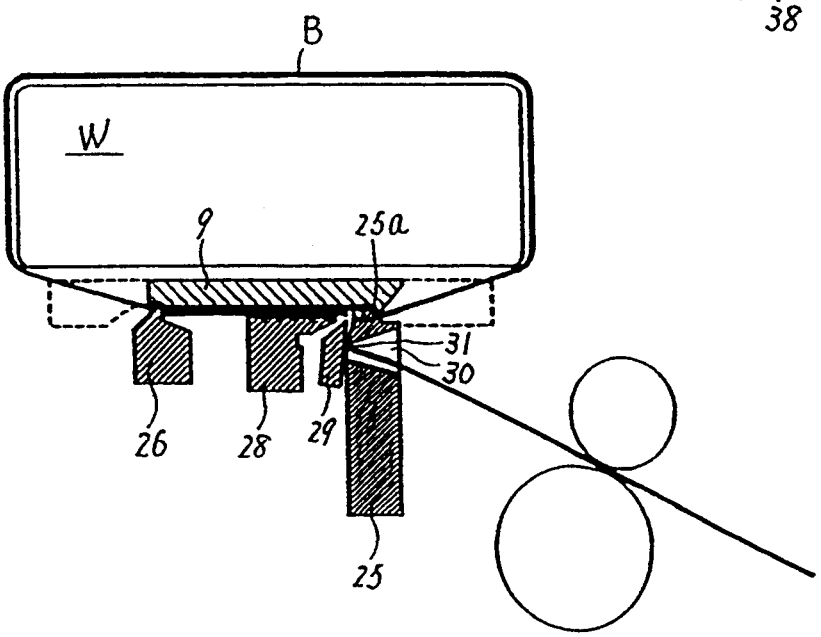
FIG. 7 PRIOR ART
Figure 8:
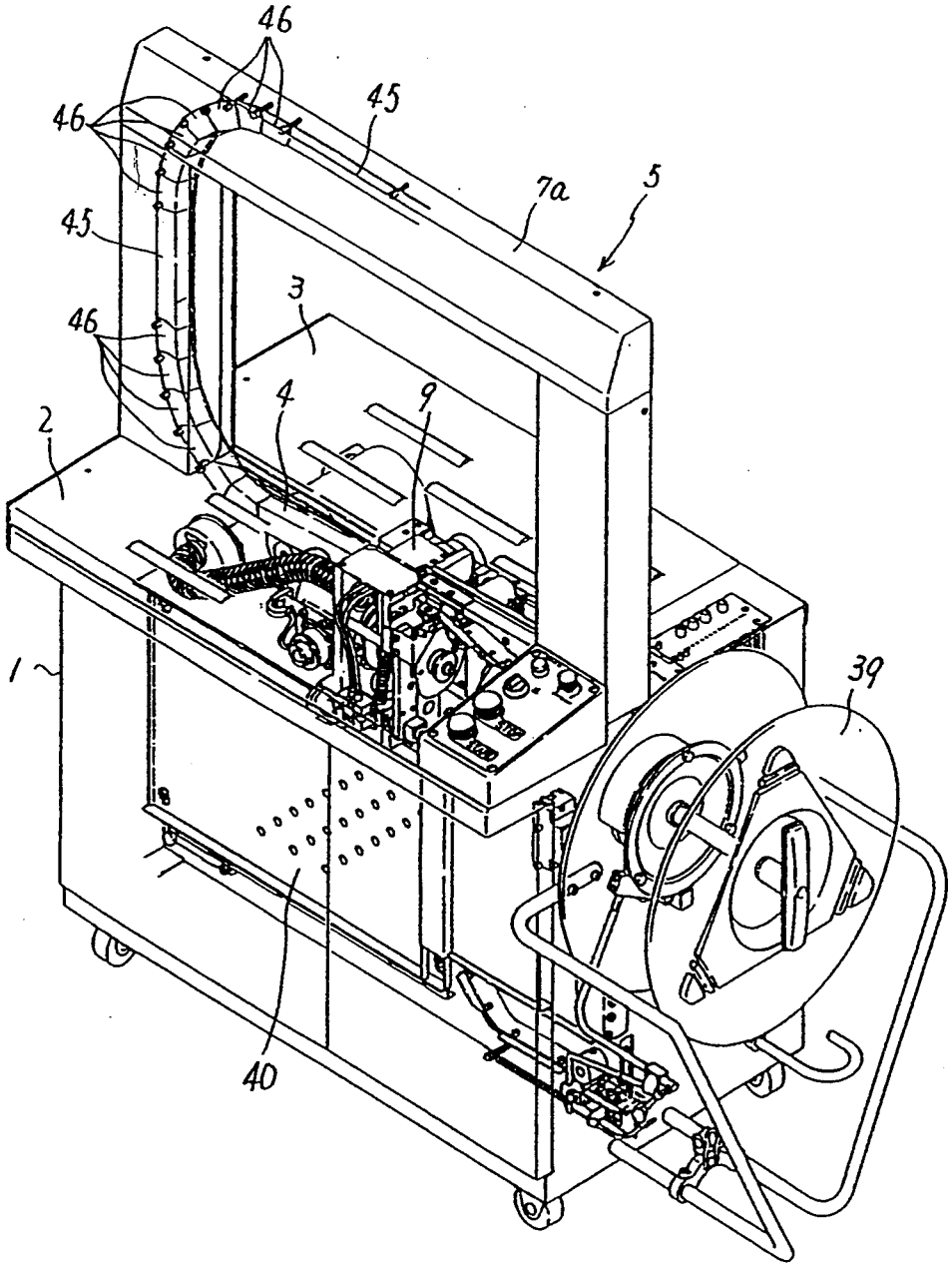
FIG. 8 is a perspective view generally showing an embodiment of a packing apparatus according to the present invention.

Referring first to FIG. 8, an embodiment of a packing apparatus according to the present invention is illustrated. A packing apparatus of the illustrated embodiment includes a pair of tables 2 and 3 acting as a package positioning means, which are fixedly arranged in a manner to be spaced from each other at a predetermined interval as in the conventional packing apparatus described above, so that a band passage 4 is defined between the tables 2 and 3. On the tables 2 and 3 is mounted a band guide arch structure 5 of a substantially inverted U-shape so as to extend between both ends of the tables and straddle the band passage 4.

Figure 9:
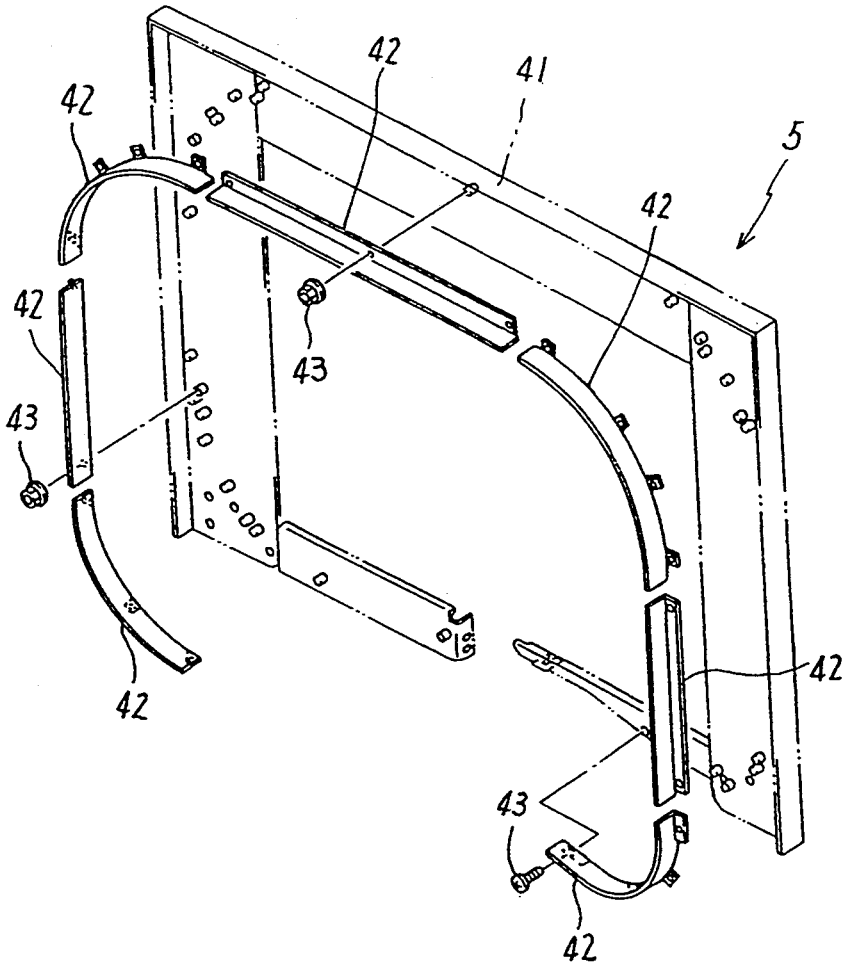
FIG. 9 is an exploded perspective view showing a band way incorporated in the packing apparatus shown in FIG. 8.

The band guide arch structure 5, as shown in FIGS. 8 and 9, is constituted by an arch frame 41 and an arch cover 7*a*. The arch frame 41 is mounted on an inner side surface thereof with a band way 42 by means of fasteners 43. A band B is adapted to travel on a surface of the band way 42.

Figure 10:
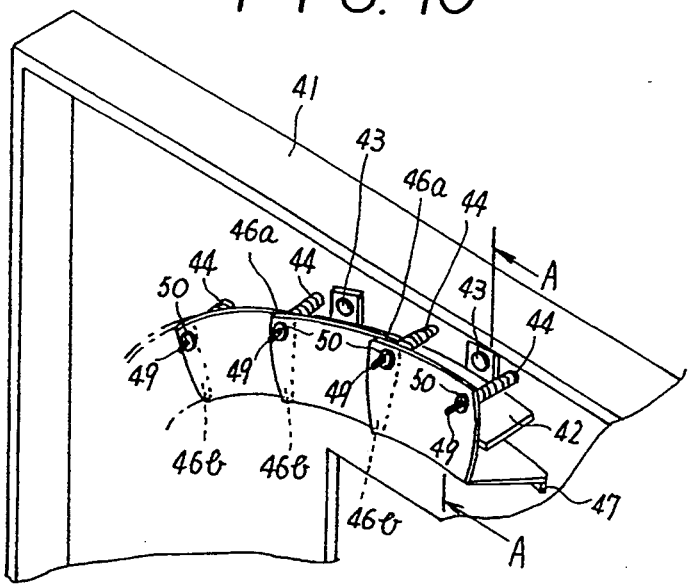
FIG. 10 is a fragmentary enlarged perspective view showing an essential part of an internal construction of a band guide arch structure in the packing apparatus shown in FIG. 8.

Also, the arch frame 41, as shown in FIG. 10, is mounted thereon with a plurality of flaps through springs 44. The flaps each are formed of a lightweight metal material such as a steel sheet of 0.2 to 0.3 mm in thickness into an L-shape in section. The flaps each are provided at one section thereof with a flange 47 of which a distal end is bent and on the other section thereof with a pair of threaded holes 48 in a manner to be in proximity to an edge of the other section.

The flaps include flaps 45 of a continuous length each arranged on each of linear or straight sections of the arch frame 41 and flaps 46 of a short length each arranged on each of corner sections of the arch frame 41.

Figure 11:
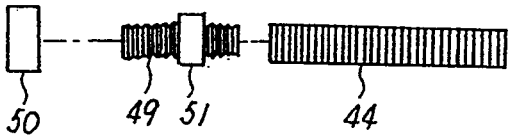
FIG. 11 is an exploded perspective view showing a spring incorporated in the internal structure shown in FIG. 10.

The springs 44, as shown in FIG. 11, each are formed into a coiled shape and have a bar-like screw 49 inserted into one end thereof. The screw 49 is fittedly mounted thereon with a ring 51 made of a resin material prior to threaded insertion of the screw 49 into the spring 44. Thus, threaded insertion of the screw 49 into the spring 44 is carried out until the ring 51 is abutted against the spring 44. The screw 49 and spring 44 have the same thread or flight pitch and the same winding density, thus, threaded connection carried out between the screw 49 and spring 44 once effectively prevents separation or release of both from each other.

Each of the corner sections of the arch frame 41 is shown in detail in FIG. 10. As shown in FIG. 10, the arch frame 41 is mounted with the band way 42. The flaps 46 of an L-shape which are arranged at the corner sections of the arch frame 41 are adapted to cover the band way 42 in such a manner that ends thereof are overlapped each other in order. In this instance, overlapping of the flaps 46 is carried out so as to permit the overlapped portions to be formed into an acute fan shape, resulting in the overlapped portions each being conformed to a curvature of the band way 42. At the L-shaped flaps 46, the band B is caused to travel and be drawn out from the flaps in a clockwise direction in FIG. 10, thus, overlapping of the flaps 46 is carried out in such a manner that a forward end of each of the flaps 46 defined in a direction of delivery of the band is positioned under a rearward end of the flap forwardly adjacent thereto while aligning the threaded holes 48 of the adjacent flaps. More specifically, in the illustrated embodiment, the overlapping is carried out in such a manner that a right-hand end 46*a* of each flap 46 is positioned inside a left-hand end 46*b* of the flap 46 adjacent thereto on the left-hand side. Then, the screw 49 integrally mounted on the spring 44 is inserted at one end thereof into the aligned threaded holes 48 of each of the overlapped portions between the flaps 46 from a side of the arch frame 41 and then a nut 50 is threadedly fitted on the screw 49 from an outside of the flap 46. This results in the spring 44 being securely positioned with respect to the arch frame 41 as shown in FIG. 12.

The above-described manner of mounting of the flaps 46 with respect to the arch frame 41 may be likewise applied to mounting of the flaps 45 of a continuous length located between the corner sections of the arch frame 41.

Figure 12:
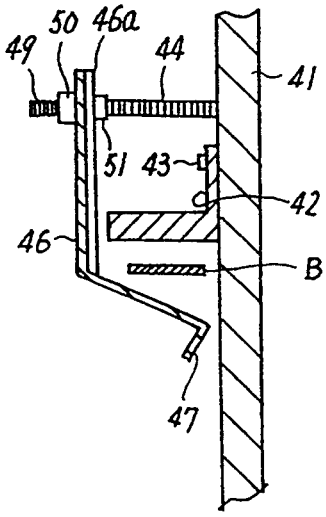
FIG. 12 is a sectional view taken along line A—A of FIG. 10.

Thus, a gap of a predetermined interval is defined between the band way 42 and the flaps 46 of an L-shape as shown in FIG. 12. The band B is permitted to travel in the gap thus formed.

The remaining part of the packing apparatus of the illustrated embodiment may be constructed in substantially the same manner as the prior art described above.

Now, the manner of operation of the packing apparatus of the illustrated embodiment will be described hereinafter with reference to FIG. 8. Also, FIGS. 1 to 7 described above in connection with the prior art will be referred to in the following description as required.

First, a package W is placed on the tables 2 and 3 so as to be positioned below the band guide arch structure 5. At this time, the band guide 22 is kept at a raised position. Then, a guide hole 30 of a right-hand presser member 25 is positioned so as to be opposite to or aligned with a guide groove 23 of the band guide 22. Subsequently, a band B wound on a reel 39 is taken out through a pool box 40 from the reel and then inserted at one end thereof through a tension mechanism and a band delivery mechanism into the guide hole 30 and guide groove 23.

Then, a feed roller 32 constituting a part of the band delivery mechanism as in the prior art is rotated in the direction of delivery of the band, to thereby permit the band B to travel at an increased speed along the band way 42 in the band guide arch structure 5. This results in a distal end of the band B being abutted against a stopper 24 of the band guide 22.

Subsequently, the right-hand presser member 25 is further upwardly moved to cause the band B to be interposedly held between a non-slip portion 25*a* of the right-hand presser member 25 and an upper presser plate 9. After the band B is thus interposedly held therebetween, the band guide 22 is retracted from a band travel path constituted by the band passage 4.

Thereafter, the feed roller 32 is rotated in a direction opposite to the above-described direction. This causes draw-back force to be applied to the band B, so that force which acts to cause the band B arranged in a loop-like manner in the gap between the band way 42 and the flaps 45 and 46 to reduce the loop is produced inward of the arch structure by the band B. This causes the springs 44 through which the flaps 45 and 46 are kept stationary to be deflected, resulting in the flaps 45 and 46 being rendered open. The flaps 45 and 46 are continuously connected to each other in turn at the above-described overlapped portions therebetween, so that the band B is drawn out from the flaps in a clockwise direction in order from a bottom left corner of the band guide arch structure 5 in FIG. 8 while forcibly opening the flaps 45 and 46 in order. This results in the band B being wound around the package W.

Then, the tension mechanism causes tension to be applied to the band B and then a left-hand presser member 26 is raised to an uppermost position, so that the band B is interposedly held between a non-slip portion 26*a* of the left-hand presser member 26 and the upper presser plate 9. In this state, the band B is so arranged that a distal portion of the band B defined between the distal end of the band B and a portion of the band interposedly held between the non-slip portion 25*a* of the right-hand presser member 25 and the upper presser plate 9 is kept vertically spaced from a proximal portion of the band positioned between the right-hand presser member 25 and the left-hand presser member 26, resulting in a gap being defined between the distal portion of the band B and the proximal portion thereof. Then, a heater 27 is inserted into the gap thus formed and then a press member 28 is upwardly moved, resulting in a lower blade 29 mounted on the press member 28 being likewise raised, so that the lower blade 29 cooperates with an upper blade 31 formed by an inlet of the above-described guide hole 30 of the right-hand presser member 25 to cut the band B. Concurrently, the heater 27 melts the distal and proximal portions of the band B between which the heater 27 is arranged. Then, the press member 28 is downwardly moved and the heater is retracted.

Thereafter, the press member 28 is raised again, so that the melted distal and proximal portions of the band B are adhered to each other. Finally, the left-hand presser member 26 and press member 28 are lowered and the upper presser plate 9 is retracted, so that the band B is firmly wound on the package W while being tightly contacted therewith.

As can be seen from the foregoing, the packing apparatus of the present invention permits drawing-out of the band from the arch frame to be positively and regularly carried out in order from a proximal side of the band B to be wound on the package to a distal side thereof. This results in drawing-out of the band from the arch frame while being kept in parallel with the band way which is considered to be ideal in the art being realized. Thus, the band is uniformly wound on the package W while being prevented from being distorted or loosened.

Also, the packing apparatus of the present invention is so constructed that a plurality of flaps of a short length which are formed into the same shape are arranged on each of the corner sections of the arch frame. Such construction leads to standardization of the flaps. Each of the flaps of a short length itself is formed into a linear shape, resulting in being manufactured with ease as compared with the curved flaps in the prior art.

Further, such formation of the flaps of a short length into a linear shape permits drawing-out of the band to be accomplished by merely opening the flaps in a slight amount. This means that the flaps are returned to the original position by movement in a slight amount. Such slight opening and movement of the flaps minimize generation of contact sound due to collision of the flaps against the arch frame.

In addition, the present invention permits the flaps to be formed into a thickness as small as 0.2 to 0.3 mm, resulting in the packing apparatus being reduced in weight and the above-described contact noise being further reduced.

Furthermore, the packing apparatus of the present invention is so constructed that the springs flexibly accommodate themselves to elongation in an axial direction thereof and flexure in a direction deviated from the axial direction. so that resistance occurring when the band is drawn out from the flaps is reduced to facilitate operation of the flaps. This permits drawing-out of the band from the arch frame to be positively and regularly carried out in order from the proximal side of the band B to be wound on the package to the distal side thereof without requiring fine adjustment of the springs of the flaps which is carried out in the conventional packing apparatus.

Thus, it is not required to vary elastic force of the springs depending on the linear and corner sections of the arch frame and adjust the springs depending on the order of drawing-out of the band, because the flaps repeat the same operation, to thereby cause load applied to the springs to be substantially uniform.

Moreover, each of the flaps is operated through two springs, so that load applied to each of the springs may be decreased. This results in an improvement in durability of the springs and therefore the packing apparatus. Also, the flaps each are provided with the flange, to thereby prevent damage to the band by an end of each of the flaps during drawing-out of the band from the flaps. This ensures smooth and safe drawing-out of the band.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A packing apparatus comprising:

package positioning means on which a package is put and kept stationary;

a band passage provided on said package positioning means;

a band guide arch structure arranged on said package positioning means and including an arch frame;

a band way provided in said band guide arch structure and including corner sections and linear sections;

a plurality of flaps openably mounted on a side of said arch frame through coil springs to cover said band way substantially over its entire width and defining, over substantially the entire length of said band way, a gap through which the band is passed;

an upper presser plate arrange so as to be retracted with respect to said band passage;

a band delivery mechanism for delivering the band and removing slack of the band after the band is wound around the package;

a holding mechanism for interposedly holding a distal end of the band between a lower surface thereof and said upper presser plate;

a tension mechanism for applying tension to the band held by said holding mechanism;

a heater arranged so as to be retracted with respect to a position below said upper presser plate such that said heater is selectively inserted between portions of the band lying one upon another below said upper presser plate to melt the portions of the band lying one upon another;

a press member for pressing said portions of the band melted by said heater to cause said melted portions to adhere to each other;

a cutter mechanism for cutting a part of the band wound on the package from the remaining part of the band;

each of said flaps being made of a lightweight metal material and having an L-shaped cross-section; said flaps having first and second edge portions, said first edge portion having a flange and said second edge portion comprising a pair of threaded holes;

said flaps being arranged contiguous to each other such that a forward end of each of said flaps defined in a direction of delivery of the band is positioned under a rearward end of the flap forwardly adjacent thereto to define an overlapped portion while said threaded holes of the adjacent flaps align with each other;

said flaps arranged at each of said corner sections of said band way being curvedly connected to each other while forming an overlapped portion having an acute fan shape between each adjacent pair of said flaps; and said coil springs deflectibly mounting said flaps to said arch structure through said threaded holes, said coil springs having first and second ends, said first end of each of said springs being coupled to a respective aligned pair of said threaded holes of an overlapped portion defined by an adjacent pair of said flaps, said second end of said springs being fixed to said band guide arch structure to thereby permit each of said flaps to be openable with respect to said band way.

2. The apparatus of claim 1, further comprising means for securing said first end of said springs to said aligned pair of threaded holes of said flaps, said means directly engaging with said flaps.

3. The apparatus of claim 2, wherein said springs have a threaded interior surface, said securing means comprising a bar-like screw extending through said aligned pair of threaded holes of both of said adjacent flaps and having first and second ends, said first end of said screw being insertable into and engaging with said threaded interior surface of said springs.

4. The apparatus of claim 3, wherein said securing means further comprise a ring mounted on said screw, said first end of said screw extending into said threaded interior surface of said spring until said spring abuts against said ring to prevent separation or release of said screw from said spring.

5. The apparatus of claim 4, wherein said securing means further comprise a nut positionable over said second end of said screw to clamp each pair of adjacent flaps between said nut and said ring.

6. The apparatus of claim 1, wherein said second end of said springs and said band way are fixed to the same element of said arch structure.

7. In a packing apparatus including package positioning means for holding a package stationary, a band guide arch structure defining a band way, flaps mounted in said arch structure to cover said band way while defining a band passage through which a band is passed, and a band delivery mechanism for delivering the band and removing slack of the band after the band is wound around the package, the improvement comprising:

each of said flaps having a forward end in a delivery direction of the band and a rearward end, the forward end of each of said flaps engaging with and being positioned closer to said band passage than the rearward end of a subsequent one of said flaps in the delivery direction such that upon release of the band from the band passage and winding the band around the package, said subsequent flap is prevented from opening before preceding ones of said flaps, said flaps having first and second edge portions in a direction transverse to the delivery direction, said first edge portion of said flaps comprising a flange and said second edge portion of said flaps comprising a pair of threaded holes, one of said threaded holes being arranged in proximity to a respective one of said forward and rearward ends, said threaded holes on said forward ends of said flaps aligning with said threaded holes on said rearward ends of adjacent ones of said flaps, and springs for deflectibly mounting said flaps to said arch structure through said threaded holes, said springs having first and second ends, said first end of each of said springs being coupled to a respective aligned pair of said threaded holes of an overlapped portion defined by an adjacent pair of said flaps, said second end of said springs being fixed to said arch structure such that each of said flaps is coupled via a pair of said springs to said arch structure.

8. The apparatus of claim 7, further comprising:

an upper presser plate arrange so as to be retracted with respect to said band passage;

holding means for holding a distal end of the band between a lower surface thereof and said upper presser plate;

tension means for applying tension to the band held by said holding means;

heating means for applying heat to melt portions of the band lying one upon another, said heating means being retractable with respect to a position below said upper presser plate and being selectively inserted between portions of the band lying one upon another below said upper presser plate to melt the portions of the band lying one upon another;

a press member for pressing said portions of the band melted by said heating means to cause said melted portions to adhere to each other; and cutting means for cutting a part of the band wound on the package from a remaining part of the band.

9. The apparatus of claim 7, further comprising means for securing said first end of said springs to said aligned pair of threaded holes of said flaps, said means directly engaging with said flaps.

10. The apparatus of claim 9, wherein said springs have a threaded interior surface, said securing means comprising a bar-like screw having first and second ends, said first end of said screw being insertable into and engaging with said threaded interior surface of said springs.

11. The apparatus of claim 10, wherein said securing means further comprise a ring mounted on said screw, said first end of said screw extending into said threaded interior surface of said spring until said spring abuts against said ring to prevent separation or release of said screw from said spring.

12. The apparatus of claim 11, wherein said screw is insertable through said threaded holes of said flaps, said securing means further comprising a nut positionable over said second end of said screw to clamp said flaps between said nut and said ring.

13. The apparatus of claim 7, wherein said second end of said springs and said band way are fixed to the same element of said arch structure.

* * * * *